US008179326B2

(12) United States Patent
Chang

(10) Patent No.: US 8,179,326 B2
(45) Date of Patent: May 15, 2012

(54) OUTDOOR MULTI-CHANNEL ANTENNA

(75) Inventor: Ming-Wen Chang, Kowloon (HK)

(73) Assignee: San Wen (H.K.) International Co., Ltd., Hong Kong (HK)

( * ) Notice: Subject to any disclaimer, the term of this patent is extended or adjusted under 35 U.S.C. 154(b) by 402 days.

(21) Appl. No.: 12/498,383

(22) Filed: Jul. 7, 2009

(65) Prior Publication Data

US 2011/0006951 A1 Jan. 13, 2011

(51) Int. Cl.
*H01Q 1/22* (2006.01)

(52) U.S. Cl. ..... 343/702; 343/872; 343/878

(58) Field of Classification Search ..... 343/892, 343/702, 718, 784, 878, 782
See application file for complete search history.

(56) References Cited

U.S. PATENT DOCUMENTS 6,310,586 B1 * 10/2001 Takahashi et al. ..... 343/872
2008/0055184 A1 * 3/2008 Noro et al. ..... 343/872
2009/0066602 A1 * 3/2009 Lindberg et al. ..... 343/834

* cited by examiner

*Primary Examiner* — Jacob Y Choi
*Assistant Examiner* — Amal Patel
(74) *Attorney, Agent, or Firm* — Leong C. Lei

(57) ABSTRACT

The outdoor multi-channel antenna mainly contains a case, a reflection box, a reception plate, and a cover. The reflection box is placed inside the case. The reception plate has an antenna waveguide element and is placed inside the reflection box. The waveguide element is fixed and positioned by a support seat. The reception plate contains a curved piece and two wing pieces bended 90 degrees downward from the curved piece. The waveguide element is attached to a back side of the reception plate and is connected via a coaxial cable to a terminal threading through the through openings of the reflection box and the case. The cover tightly seals the case by a ring washer sandwiched therebetween and a waterproof plug sleeves over the terminal.

2 Claims, 8 Drawing Sheets

OUTDOOR MULTI-CHANNEL ANTENNA

TECHNICAL FIELD OF THE INVENTION

The present invention generally relates to outdoor multi-channel antennas, and especially relates to an outdoor antenna where a reception plate configured with an antenna waveguide element is placed in a reflection box and, due to the reflection and concentration from the side walls of the reflection box, the antenna enjoys a wider reception angle and an enhanced signal gain. In addition, the outdoor antenna employs a washer to achieve superior water-tightness.

DESCRIPTION OF THE PRIOR ART

For receiving broadcast television programs, an outdoor or indoor antenna is a required device. For a conventional indoor antenna, as illustrated in FIG. 1, mainly contains a circuit board 1 having a circuit region 11 in a middle area and reception plates 111 at the lateral sides of the circuit region 1. Both the circuit region 11 and the reception plates 111 are printed on a major side of the circuit board 1. The reception plates 111 are for receiving UHF signals and, for VHF signals, copper strips 112 are provided and connected to the circuit region 11. As described, the conventional antenna has a very simple structure. However, the reception plates 111 actually take up most of the circuit board's area and thereby contribute some significant production cost as circuit boards are priced by their dimensions. Additionally, indoor antennas, as they are confined within building constructions, usually suffer blind spots and interferences.

In contrast, outdoor antennas do not have this drawback and, for remote places having reception problems, outdoor antennas seem to be a more appropriate approach. Conventionally, an outdoor antenna has a fishbone structure with parallel aluminum tubes and is raised high on a pole. A wiring box is provided on the pole which connects the outdoor antenna to a cable leading to the television set. The outdoor antenna usually has to be aimed at the signal source for enhanced reception. In addition, the outdoor antenna, as it is directly exposed to sun and rain, could be damaged easily. During windy or rainy days, the outdoor antenna's reception quality is also compromised.

SUMMARY OF THE INVENTION

Therefore, an outdoor multi-channel antenna is provided herein, which mainly contains a case, a reflection box, a reception plate, and a cover. The case has a hollow container shape with a fixing set to position the antenna on a pole. The reflection box is placed inside the case and is formed by bending a reflection plate. The reception plate contains a curved piece and two wing pieces bended 90 degrees downward from the curved piece. An antenna waveguide element is attached to a bottom side of the reception plate by a support seat of the reflection box. The antenna waveguide element is connected via a coaxial cable to a terminal threading through the through openings of the reflection box and the case. The cover tightly seals the case by a ring washer sandwiched therebetween and a waterproof plug sleeves over the terminal. As such, the antenna of the present invention has enhanced water-tightness, more reliable signal reception with wider reception angle, and an improved gain.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
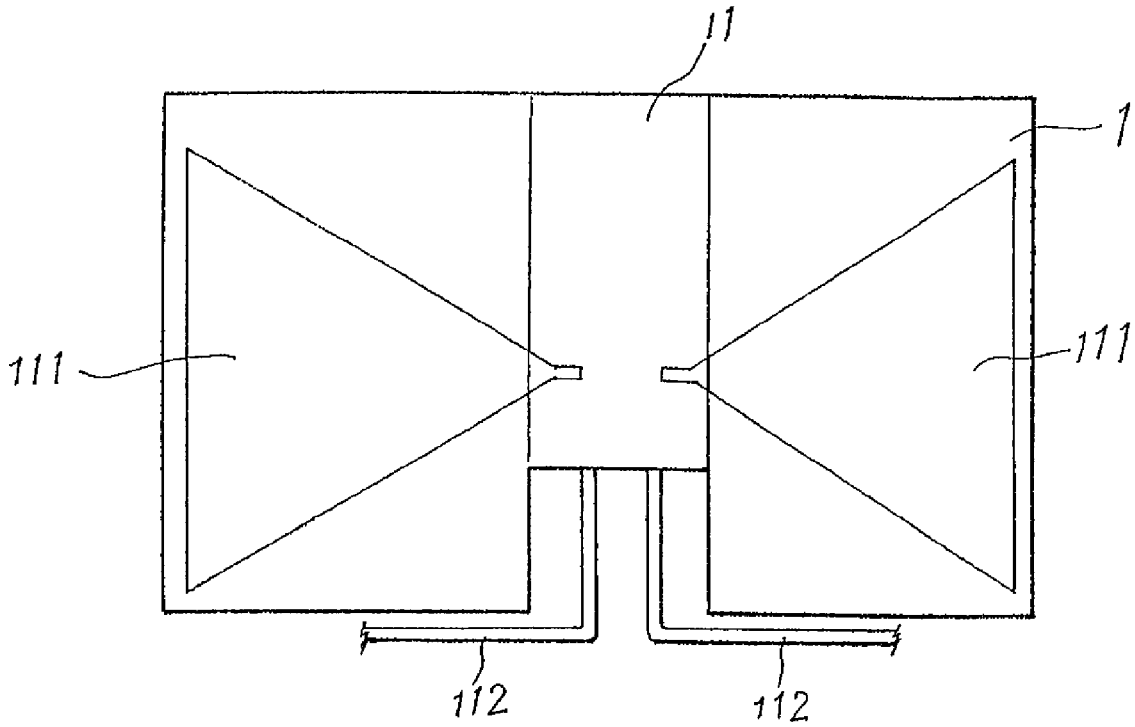
FIG.1 PRIOR ART
FIG. 1 is a schematic diagram showing a circuit board of conventional indoor antenna.
Figure 2:
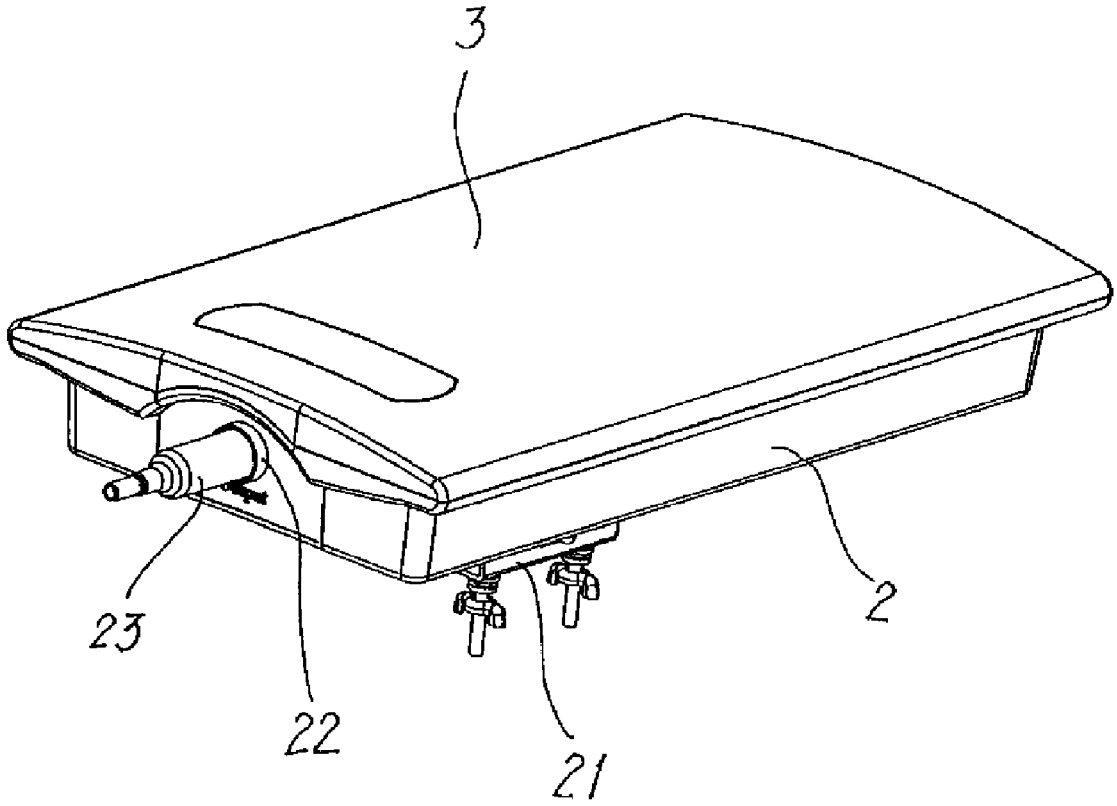
FIG. 2 is a perspective diagram showing the appearance of an antenna according to an embodiment of the present invention.

As illustrated in FIG. 2, an antenna according to an embodiment of the present invention has a flat box body composed of a cover 3 and a case 2. On the external surface of a bottom side of the case 2, a fixing set 21 is provided to fix the antenna on a pole or other object. This should be well known to people of the related art and the details are omitted here. The cover 3 tightly seals a top opening of the case 2. A through opening 22 is provided on a lateral side of the case 2 and is sealed by a waterproof plug 23. As such, the flat box body of the antenna has superior waterproof property.

Figure 3:
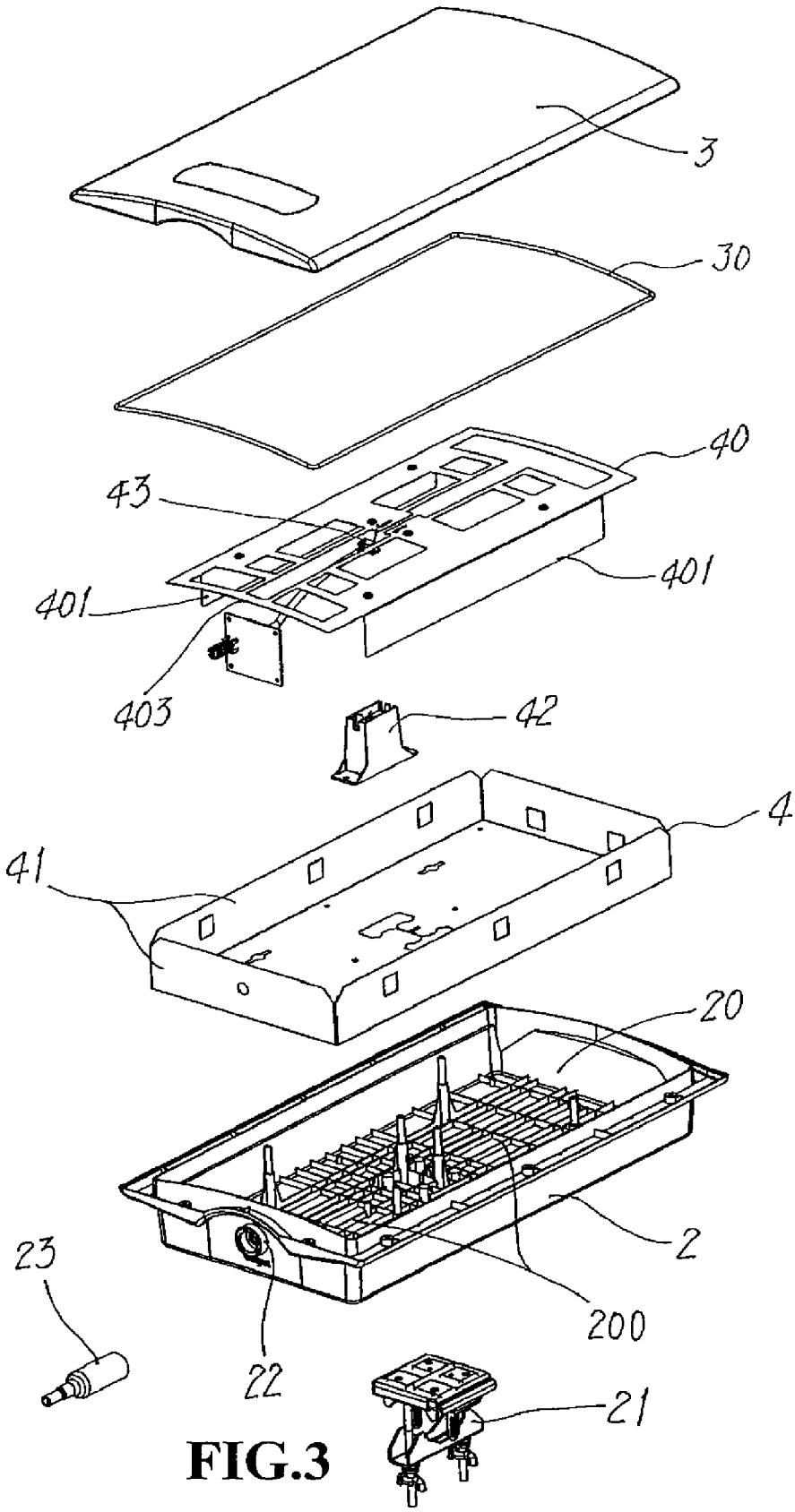
FIG. 3 is a perspective break-down diagram showing the various components of the antenna of FIG. 2.

As further shown in FIG. 3, inside the enclosed space between the cover 3 and the case 2, a reflection box 4 and a reception plate 40 are provided. The case 2 has a hollow container shape with a top-open indentation 20 for the accommodation and positioning of the reflection box 4. On a bottom surface of the indentation 20, there are a number of ribs 200 for enhancing the strength of the case 2. The reflection box 4 is shaped similar to that of the case 2 with four side walls 41. The reception plate 40 is a plate having a curved piece 403 whose two major sides are bended downward for 90 degrees to form two wing pieces 401. The reception plate 40 is positioned inside the reflection box 4 and a support seat 42 is positioned therebetween to lock the reception plate 40. A ring washer 30 is provided between the cover 3 and the case 2 for enhanced water-tightness, and then the cover 3 is applied to seal the reception plate 40 and the reflection box 4 inside the case 2.

Figure 4:
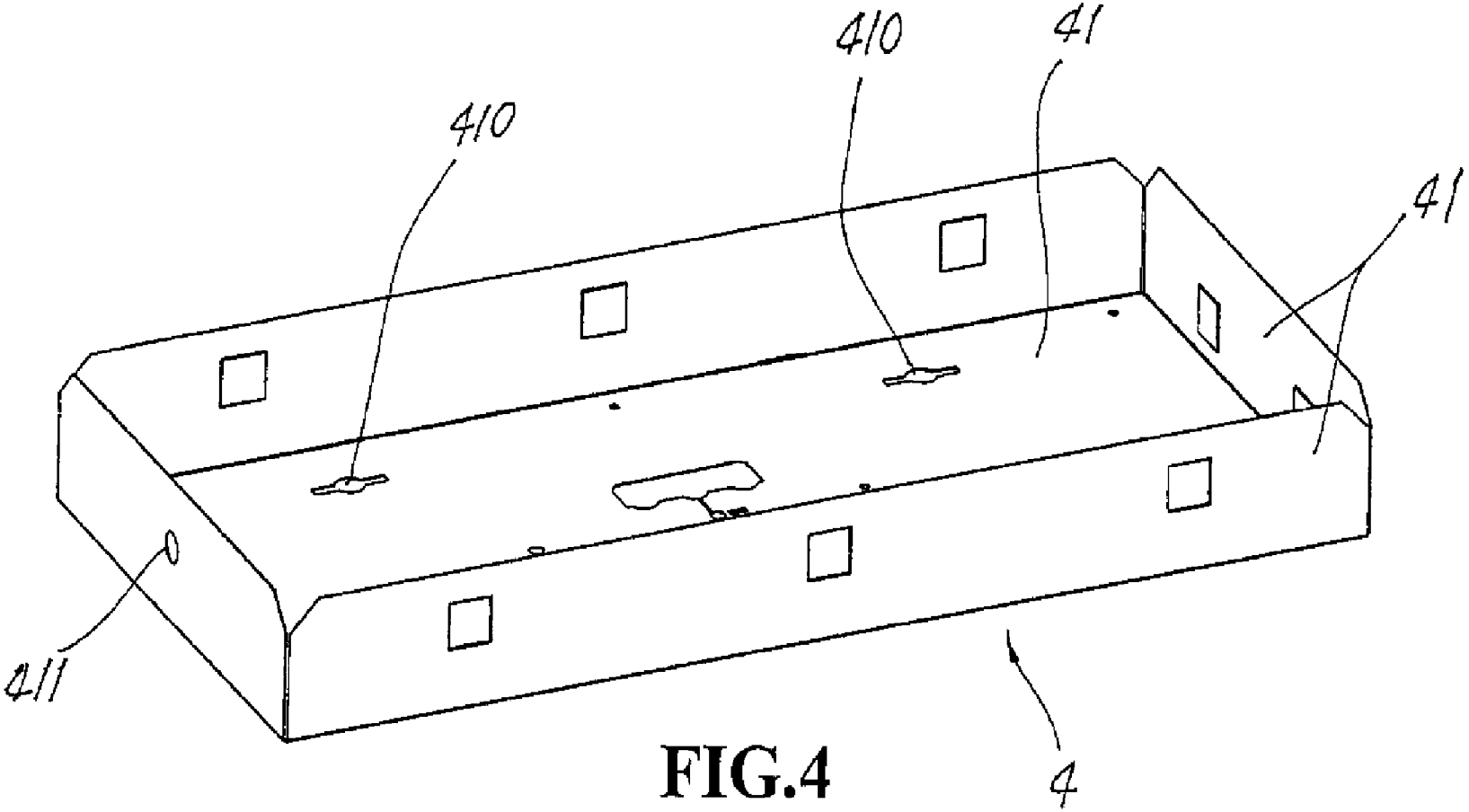
FIG. 4 is a perspective diagram showing the reflection box of the antenna of FIG. 2.
Figure 5:
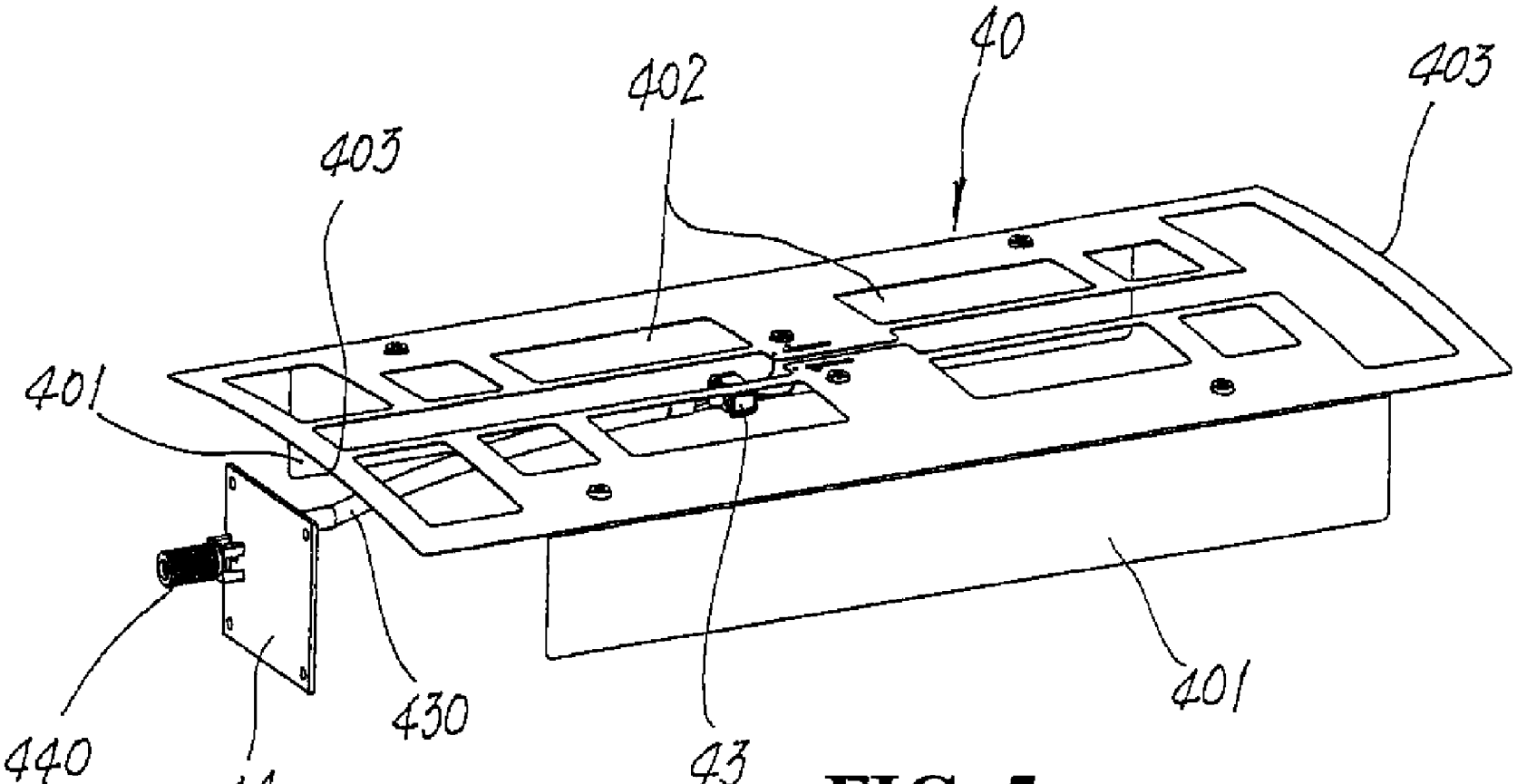
FIG. 5 is a perspective diagram showing the reception plate of the antenna of FIG. 2.

FIG. 4 is a perspective diagram showing the reflection box 4 of the present embodiment. As illustrated, the reflection box 4 is formed by bending the four sides of a reflection plate into having a hollow container shape with four upright side walls 41 for reflecting and concentrating the broadcast signals. On a bottom side of the reflection box 4, a number of slots 410 are punched or cut in advance for positioning the reflection box 4 when it is placed inside the case 2. The reflection box 4 is placed on top of the ribs 200 so that a gap is maintained between the reflection box 4 and the case 2. A through opening 411 is also provided on one of the side walls 41. FIG. 5 is a perspective diagram showing the reception plate 40 of the present embodiment. As illustrated, the reception plate 40 is specifically configured with the curved piece 403 which has a number of corresponding openings 402 so as to avoid reception loss by using air as medium. An antenna waveguide element 43 is configured on a bottom side of the curved piece 403. An end of the antenna waveguide element 43 is connected to the center of the bottom side of the curved piece 403. The other end of the antenna waveguide element 43 is connected to a side of a control board 44 through a coaxial cable 430. The control board 44 has a terminal 440 on an opposite side, which could be threaded through the through opening 411 of the reflection box 4, the through opening 22 of the case 2, and into the waterproof plug 23.

Figure 6:
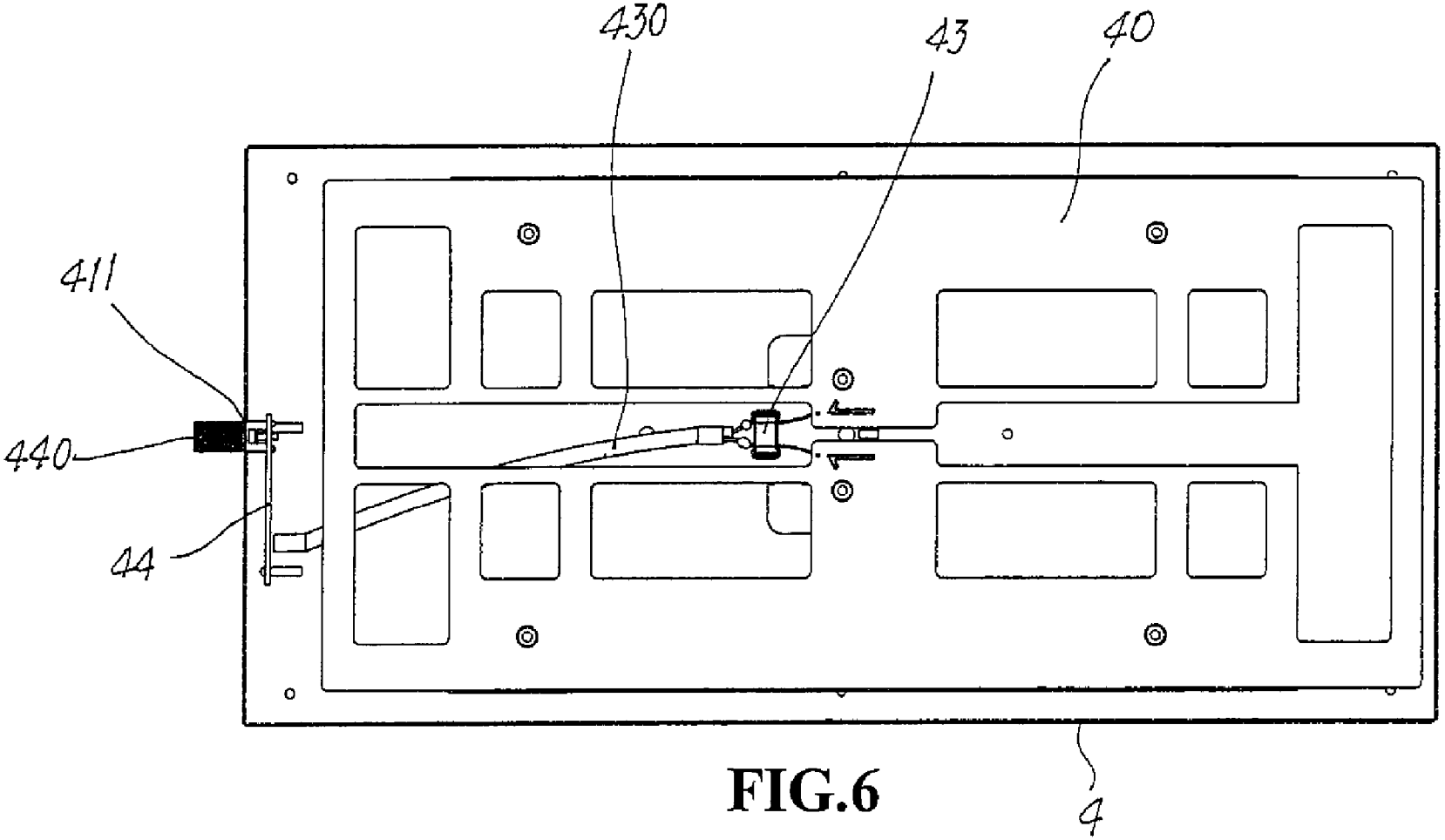
FIG. 6 is a top-view diagram showing the assembly of the reception plate and the reflection box of the antenna of FIG. 2.

The assembly of the reception plate 40 and the reflection box 4 is shown in FIG. 6. As illustrated, when the reception plate 40 is placed inside the reflection box 4, the antenna waveguide element 43 is supported and positioned by the support seat 42. Then, the control board 44 is fixed adjacent to the through opening 411 of the reflection box 4 so that the terminal 440 penetrates through the through opening 411. When the assembly of the reception plate 40 and the reflection box 4 is placed inside the base 2, the terminal 440 is also configured to penetrate through the through opening 22. As such, a remote television could be connected to the antenna by running a coaxial cable from the terminal 440 to the television.

The operation of the antenna is as follows. The broadcast signals are received by the antenna waveguide element 43 and, by the reception plate 40 and the side walls 41 of the reception box 4, the antenna has enhanced reception angle and area. In addition, as the broadcast signals are reflected and concentrated, the antenna has significantly superior reliability. Especially with the wing pieces 401 and the curved piece 403, the antenna has a high gain for UHF signals. In other words, by the assembly of the reception plate 40 and the reflection box 4, the present invention provides improved signal reception and reliability. Together with the watertight sealing from the cover 3 and the case 2, the antenna is protected against the damage from direct exposure to sun and rain.

Figure 7:
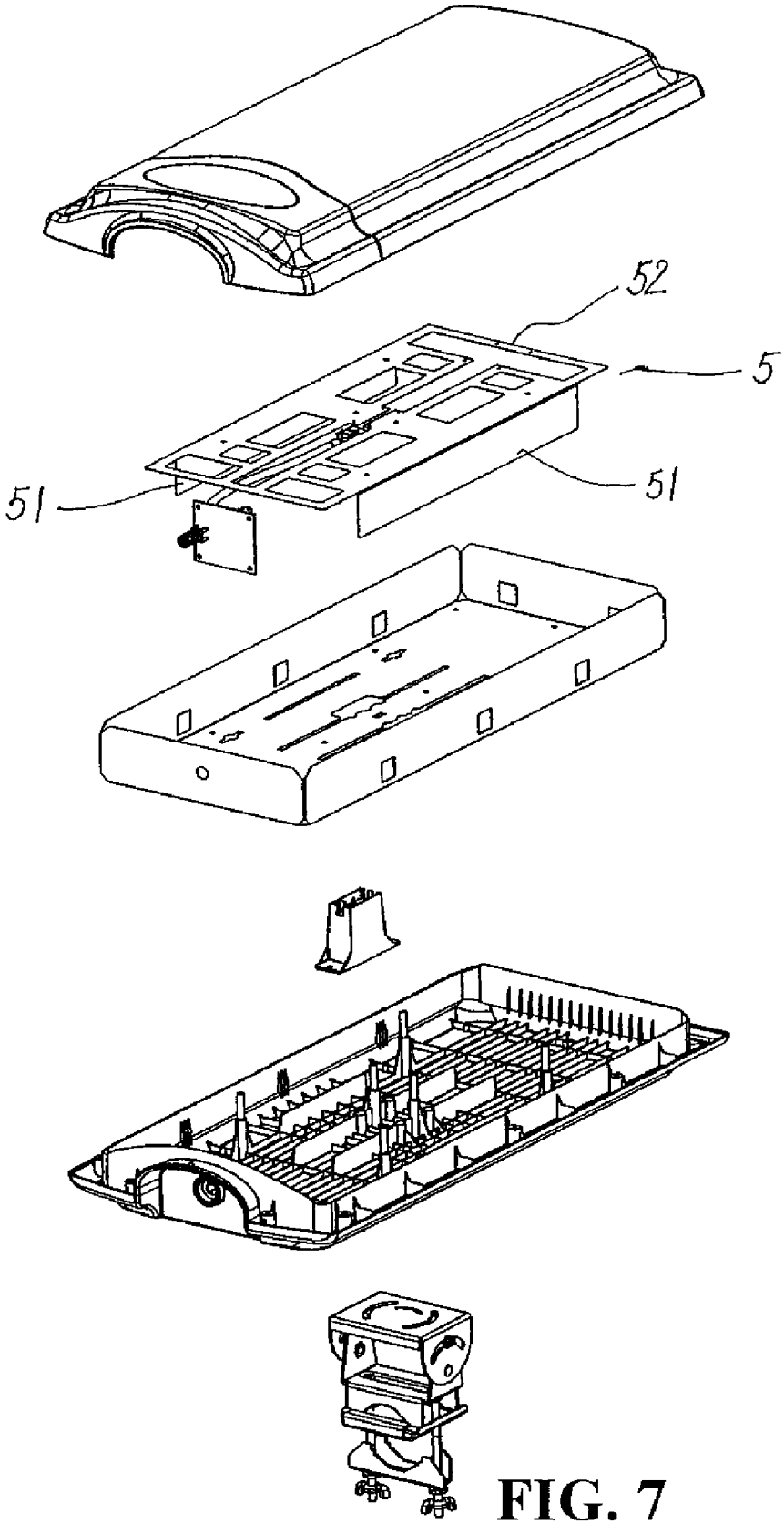
FIG. 7 is a perspective break-down diagram showing the various components of an antenna according to another embodiment of the present invention.
Figure 8:
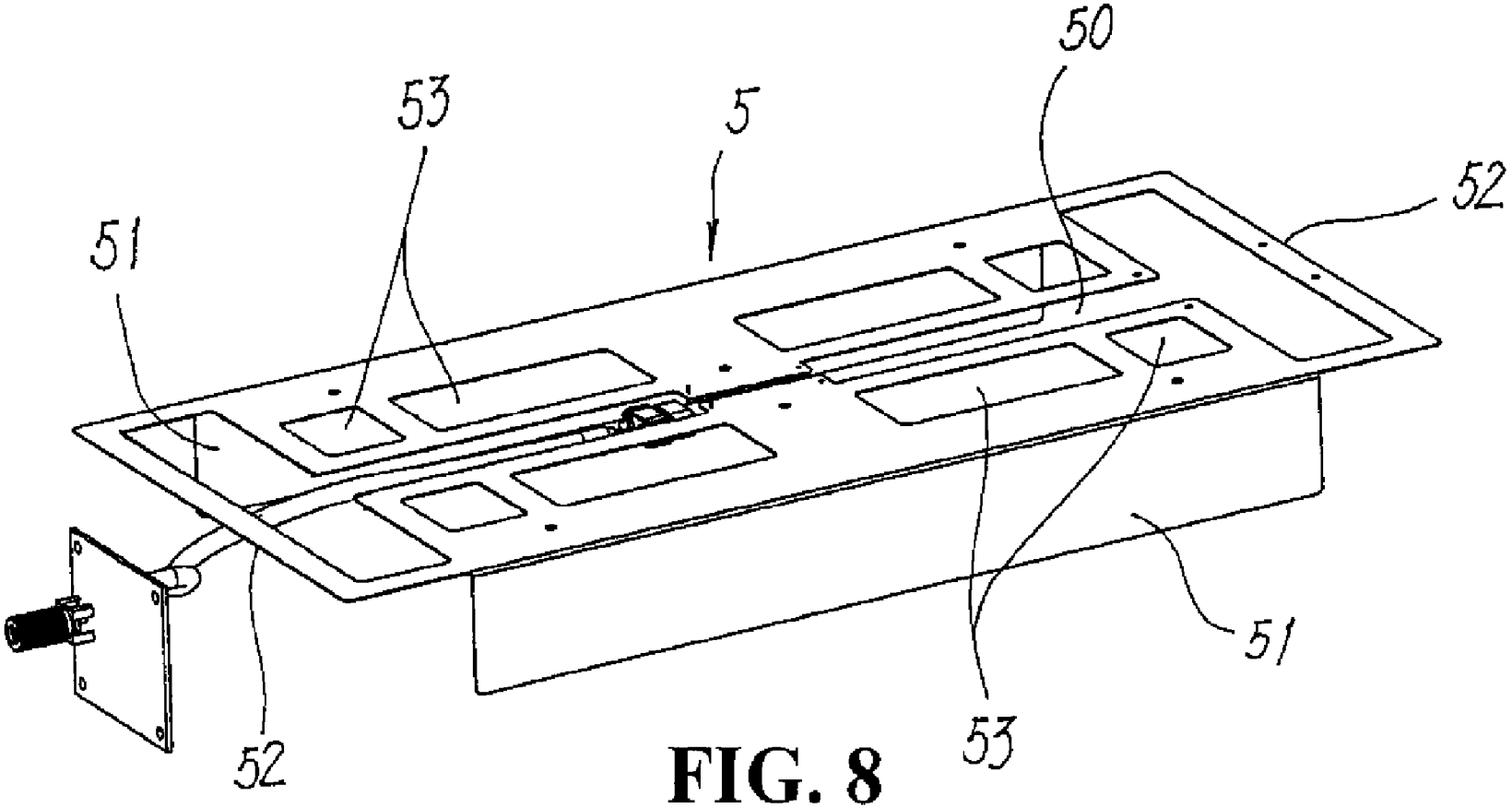
FIG. 8 is a perspective diagram showing the reception plate of the antenna of FIG. 7.

FIG. 7 provides an antenna according to another embodiment of the present invention. As illustrated, the antenna also mainly contains a cover, a reception plate 5, a reflection box, and a case. The difference lies in, depending on the received signals' frequency bands, the reception plate 5 could be shaped differently. As shown in FIG. 8, the reception plate 5 is also a plate with downward bended wing pieces 51. But, unlike the previous embodiment, the reception plate 5 mainly contains a flat piece 52, instead of a curved piece. The antenna of the present embodiment could then be applied to the reception of signals of different frequency bands while maintaining a high gain. By having a number of corresponding openings 53 across a slot 50 in the middle on the reception plate 5, air is used as a medium to avoid reception loss. In addition, when the slot 50 is connected to the openings 53 at its sides, the signal wavelength receivable by the antenna is increased and the antenna therefore is able to receive signals in the VHF band.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An outdoor multi-channel antenna comprising:

a rectangular case having a hollow container shape with a top-open indentation, said indentation having an inner bottom surface on which there are a plurality of ribs for enhancing strength of said case;

a rectangular reflection box formed by bending four sides of a reflection plate into a hollow container with four upward side walls for reflecting and concentrating broadcast signals, said hollow container being adapted to be placed inside said case, said reflection box having a bottom side formed with a plurality of slots;

a reception plate positioned inside said reflection box, said reception plate having a curved piece which has a plurality of openings so as to avoid reception loss by using air as a medium, said curved piece having two sides bent downward into two wing pieces, said curved piece having a bottom provided with an antenna waveguide element;

a control board connected to said antenna waveguide element through a coaxial cable, said control board having a terminal threaded through a through opening of said reflection box and a through hole of said case into a waterproof plug;

a cover engaged with said case; and a ring washer fitted between said cover and said case for enhanced water-tightness.

2. The outdoor multi-channel antenna as claimed in claim 1, wherein said wing pieces have a 90-degree inclined angle to said curved piece.

* * * * *